United States Patent [19]

Robertson, Jr.

[11] Patent Number: 4,948,119

[45] Date of Patent: Aug. 14, 1990

[54] SWIMMING MOTION EXERCISE MACHINE

[76] Inventor: Richard T. Robertson, Jr., 1210 N.W. 19th Ave., Portland, Oreg. 97209

[21] Appl. No.: 31,756

[22] Filed: Mar. 30, 1987

[51] Int. Cl.[5] ..... A63B 69/10

[52] U.S. Cl. ..... 272/71; 272/132

[58] Field of Search ..... 272/71, 97, 116, 135, 272/132, 144, 134, 136, 118, DIG. 4

[56] References Cited

U.S. PATENT DOCUMENTS

| | | | |
|---|---|---|---|
| 1,176,365 | 3/1916 | Hartnett . | |
| 2,019,224 | 10/1935 | Hess . | |
| 2,033,275 | 3/1936 | Campbell . | |
| 3,373,993 | 3/1968 | Oja et al. | 272/118 |
| 3,708,167 | 1/1973 | Potgieter | 272/DIG. 4 X |
| 3,814,084 | 6/1974 | Gustafson . | |
| 3,995,853 | 12/1976 | Deluty | 272/132 |
| 4,355,633 | 10/1982 | Heilbrun . | |
| 4,422,634 | 12/1983 | Hopkins | 272/71 |
| 4,505,475 | 3/1985 | Olschansky et al. | 272/134 X |
| 4,550,908 | 11/1985 | Dixon | 272/134 X |
| 4,560,160 | 12/1985 | Smith . | |
| 4,609,190 | 9/1986 | Brentham | 272/144 X |
| 4,625,962 | 12/1986 | Street | 282/97 X |
| 4,674,740 | 6/1987 | Iams et al. | 272/71 |
| 4,684,126 | 8/1987 | Dalebout et al. | 272/132 |

FOREIGN PATENT DOCUMENTS

| | | | |
|---|---|---|---|
| 2833418 | 2/1980 | Fed. Rep. of Germany | 272/71 |
| 961723 | 9/1982 | U.S.S.R. . | |

*Primary Examiner*—Richard J. Apley
*Assistant Examiner*—H. N. Flaxman
*Attorney, Agent, or Firm*—Chernoff, Vilhauer, McClung & Stenzel

[57] ABSTRACT

The exercise device of the present invention is comprised of a seat which supports the user in a generally upright position where the arms and legs are free to move in a manner similar to that encountered while swimming. The seat is supported above a base having resistance devices located at one of its ends which impart resistance against the movement of the legs when they are moved in an oscillatory motion about the hips. Located on the other end of the base is an upright post which supports resistance devices above and ahead of the user that impart resistance to the movement of the arms when they are moved in a rotary motion about the shoulders. In a preferred embodiment of the invention the resistance devices comprise rotatably mounted reels which have cables wound onto them. Springs resist rotation of the reels when the cables are unwound from them due to their being pulled, and rewinds the cables back onto the reels when the cables are released. One-way clutches limit the speed at which the cables are wound back onto the reels in order to prevent the cables from pulling the user's arms or legs when they are being moved toward the resistance devices.

13 Claims, 1 Drawing Sheet

SWIMMING MOTION EXERCISE MACHINE

BACKGROUND AND SUMMARY OF THE INVENTION

This invention relates to a device for exercising a user's arms and legs as they are moved in a simulated swimming motion, and in particular to such a device which supports the user in an upright orientation while the exercise is being performed.

Swimming is an excellent form of exercise since it provides tone to a wide variety of muscles in both the upper and lower body and promotes cardiovascular fitness. However, many people do not swim well enough to take advantage of this form of exercise and many people who are adequate swimmers are bothered by chlorine or do not have access to a pool.

In order to make this excellent form of exercise available to a wider range of people, exercise devices have been provided which simulate the resistance encountered by the user's arms and legs when they are moved in a swimming motion. Typical of these devices are Kien, U.S.S.R. Patent No. 961,723, Hess, U.S. Pat. No. 2,019,224, Campbell, U.S. Pat. No. 2,033,275 and Hartnett, U.S. Pat. No. 1,176,365. However, all of these devices require the user to lie on their stomach in a prone position while exercising which is extremely uncomfortable. While there are devices for exercising a person's arms while they remain in an upright position, such as Smith, U.S. Pat. No. 4,560,160, Gustafson, U.S. Pat. No. 3,814,084 and Heilbrun, U.S. Pat. No. 4,355,633, these devices do not provide for exercising the user's legs.

The present invention overcomes these shortcomings and limitations of the prior art exercise devices by providing an elongate base which sits on the floor and supports the remaining elements of the device. A seat support located on the base intermediate its ends carries a seat which supports a user in a generally vertical orientation with his or her legs and arms being free to move about the hips and shoulders respectively without interfering with either the floor or the device itself. The seat is equipped with a belt which holds the user into the seat while exercising. The length of the base, the height of the post and the height of the seat support all are adjustable in order to accommodate different-sized users and to facilitate storage of the device. A set of wheels located at the extremity of the base assists in its extension and retraction.

Located at one end of the base is an upright post. Extending out from the extremity of the post is a horizontal T-shaped arm having resistance devices located at both ends of the crossbars of the T which are arranged for exercising the arms of a user sitting in the seat when they are rotated about the shoulders in a swimming motion. Located at the other end of the base is a vertical T-shaped support having resistance devices located at both ends of the crossbar of the T which are arranged for exercising the legs of a user sitting in the seat when they are oscillated in a kicking motion.

The preferred embodiment of the resistance device comprises a rotatably mounted reel which has a flexible cable wound onto it. One end of the cable is attached to the reel and the other end is attached either to a strap which can be attached to the user's ankles, or to a handle which can be held in the user's hand. The reel is attached to a spring which resists rotation of the reel when the cable is being unwound from it and causes the reel to rewind the cable onto it when the cable is released. A one-way clutch associated with the reel limits its speed of rotation when it is being rotated by the spring to rewind the cable. When the resistance devices are attached to a user's arms and legs and they are moved in a motion similar to that used while swimming a resistance comparable to that experienced when swimming is exerted on them.

Accordingly, it is a principal object of the present invention to provide an exercise device which imparts resistance to a user's arms and legs when they are moved in a motion which is similar to that used when swimming.

It is a further object of the present invention to provide such a device which supports the user in a generally vertical orientation while the exercise is being performed.

It is a further object of the present invention to provide such a device in which resistance is applied to the arms and legs only while they are being moved in one direction.

It is a still further object of the present invention to provide such a device which accommodates users of varying sizes.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
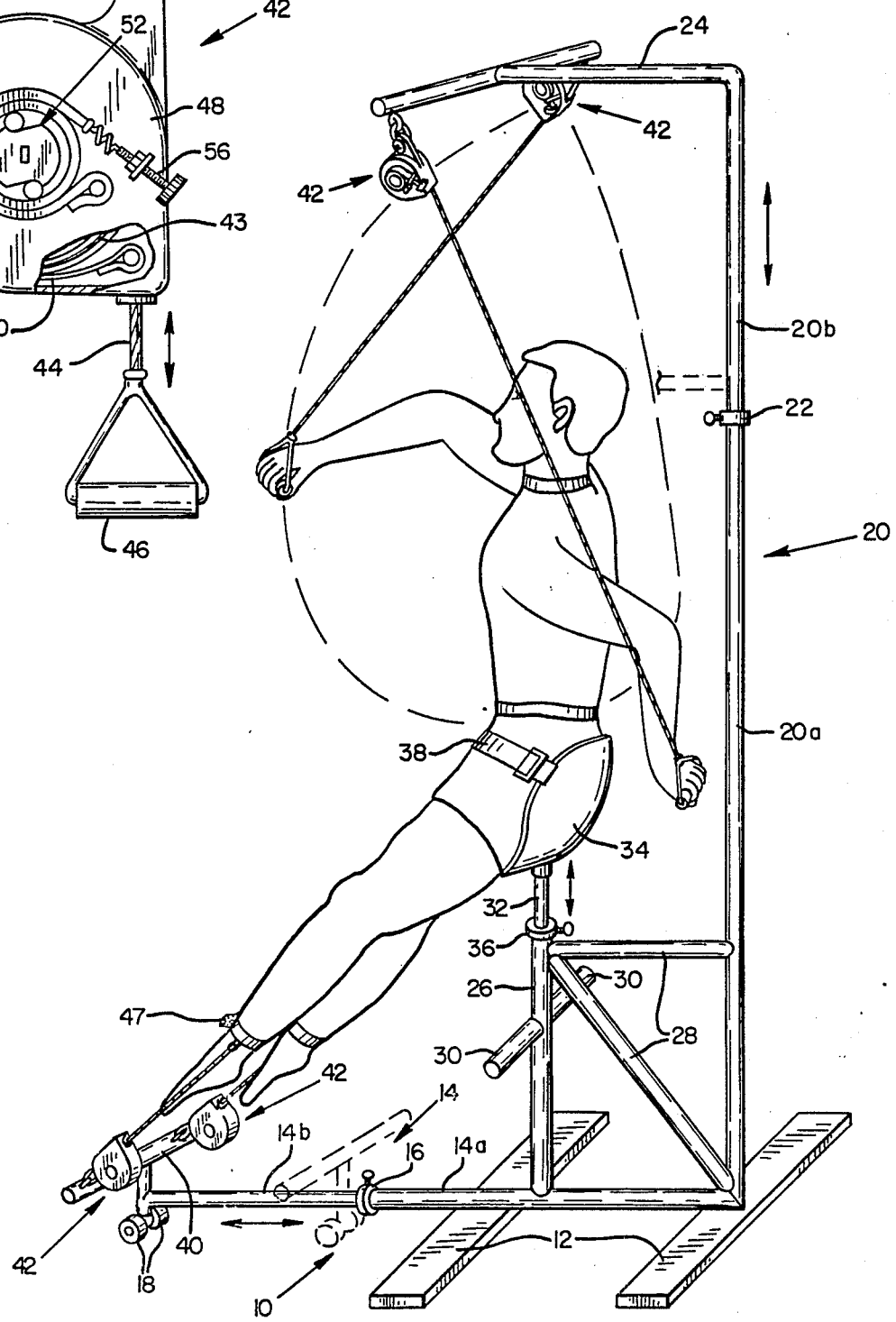
FIG. 1 is a side elevational view of an exercise device embodying the present invention with portions of the device being shown in a collapsed or stored position in dashed line.

Referring to FIG. 1 of the drawings, the exercise device of the present invention comprises a base 10 which supports the remainder of the device. In the embodiment illustrated the base includes two rectangular feet 12 which have an elongate tubular rod 14 attached to them. The rod 14 is separated into a fixed portion **14*a* which is attached to the feet 12 and a telescoping portion 14*b* which moves relative to the fixed portion in order to vary the length of the base. A lock 16 located at the intersection of the two rod portions locks them together when they are at the desired degree of extension. Located at the extremity of the telescoping rod portion 14*b* is a set of wheels 18** which facilitates its extension and retraction.

Extending upwardly from the free end of the fixed portion of the rod is an upright post 20. The post also is divided into two portions, with a fixed portion **20*a* being attached to the base 10 and a telescoping portion 20*b* extending upwardly from the fixed portion. A lock 22, which is similar to lock 16, locks the two post portions together at the desired degree of extension. Extending horizontally from the extremity of the telescoping portion of the post is a T-shaped arm 24 which is generally coplanar with the base 10**.

Extending upwardly from the fixed portion of the rod 14, approximately midway between the post 20 and the lock 16, is a seat support 26 which terminates at a height which is below the crotch of the shortest potential user of the device. The seat support is tied to the post by horizontal and diagonal links 28 to provide rigidity. Foot supports 30 extend outwardly from the middle of the seat support to assist the user in mounting the device. Slidably extending into the upper end of the seat support is a post 32 which has a seat 34 attached to its upper extremity. The post is sufficiently long that when it is fully extended the feet of the tallest user of the device will not touch the ground when the user is sitting in the seat 34. A lock 36 located on the seat support locks the post 32 to the seat support when the seat is located at its desired position. The seat 34 can be of any shape which will comfortably support a person in a generally upright position with his or her legs free to move in a kicking motion similar to that used while swimming A seatbelt 38 secures the user in the seat when he or she is using the device for performing the exercise described below.

Figure 2:
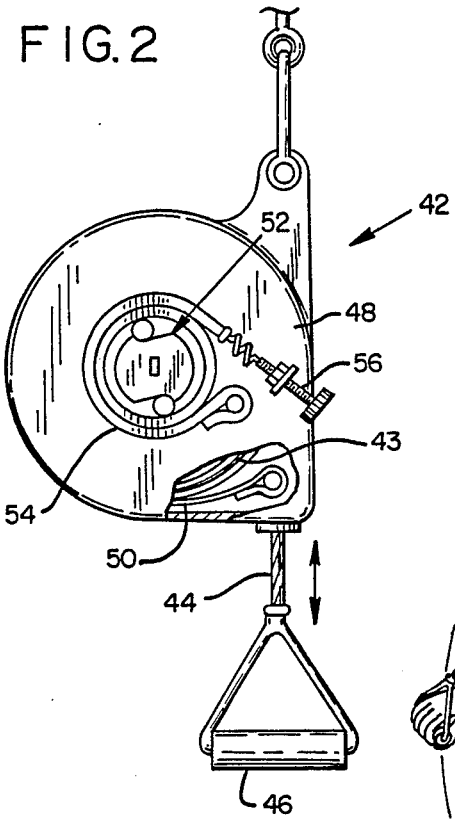
FIG. 2 is a side elevation view of a resistance device which is a feature of the present invention, shown at enlarged scale.

Mounted on the extremity of the telescoping rod portion **14*b* is a T-shaped support 40 which has a resistance device 42 attached to each of its extremities. Two additional resistance devices 42 are located at the two extremities of the arm 24. Referring to FIG. 2, in the embodiment illustrated the resistance device comprises a reel 43 which has a cable 44 wrapped around it. One end of the cable 44 is attached to the reel and the other end is attached either to a handle 46 or to a mounting strap 47. The reel is rotatably mounted in a case 48 which is attached to the arm 24 or support 40. A spring 50, which extends between the reel and the case, permits the reel to be rotated when the cable is unwound from it but imparts resistance against the rotation. When the cable is released the spring rotates the reel in the opposite direction to wrap the cable back onto it In order to prevent the cable from being retracted too rapidly, a one-way clutch 52 imparts drag to the reel when the cable is being rewound onto it but not when the cable is being unwound. The clutch 52 works against a spring 54 which has a tension adjustment knob 56** attached. Thus, by adjusting the spring tension it is possible to vary the rate at which the cable is rewound onto the reel.

In order to exercise with the device it first is adjusted to fit the particular user. The post 32 of the seat 34 is positioned so that the user's feet don't touch the floor, the post 20 is adjusted so that the arm 24 is located above the user's hands when they are extended overhead and the rod 14 is adjusted so that the support 40 is beyond the user's toes when his or her legs are extended. These adjustable elements not only permit the device to be used by a wide range of users but permit it to be collapsed for storage. The user then sits on the seat 34 and is secured to it by means of the belt 38. The straps 47 on the cables 44 of the resistance devices 42 which are located on the support 40 are attached to the user's ankles and the handles 46 on the resistance device 42 on the arm 24 are placed in the user's hands. The user then moves his or her arms in a rotary motion about the shoulders and moves his or her legs in an oscillatory kicking motion about the hips. As each arm or leg is moved away from the resistance device to which it is attached the associated cable is unwound from its reel against the spring 50 and the resulting resistance is imparted to the member pulling it. Thus the arms and legs must exert a force to overcome this resistance as they travel in one direction. This is similar to the force required to move them through the water and propel the user when swimming.

Similarly to swimming, when the arms and legs are moved in the opposite direction no resistance is imparted to them. The clutch 52 on each resistance device is adjusted for the speed at which the exercise will occur so that the associated spring 50 will not pull the user's arms or legs towards the respective resistance device on the return stroke but still will retract the cable. Since the user's arms and legs are completely unrestricted any swimming stroke can be simulated by the device. However, since the user remains in an upright orientation he or she remains comfortable while performing the exercises.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise device comprising:

(a) seat means for supporting a user in a generally vertical orientation and, while supporting the user in said orientation, permitting the user's arms to move in a rotary pattern about the shoulders and the user's legs to move in an oscillatory pattern about the hips while depending downwardly from the hips;

(b) means for yieldably imposing resistance to the movement of the user's arms when the user is supported by said seat means in said orientation and said arms are moved in a rotary pattern about the shoulders; and (c) means for yieldably imposing resistance to the movement of the user's legs when the user is supported in said orientation by said seat means and said legs are moved in an oscillatory pattern about the hips while depending downwardly from the hips.

2. The device of claim 1 wherein said means for yieldably imposing resistance to the movement of the user's arms is disposed above the head of the user.

3. The device of claim 1 wherein said seat means comprises a raised seat having a restraint device which secures the user to it.

4. The device of claim 1 wherein both of said means for yieldably imposing resistance comprise:

(a) a rotatably mounted reel;

(b) a cable having a first end which is attached to said reel and a second end for attaching to a limb of the user; and (c) spring means for rotatably urging said reel in a direction which will cause said cable to become wound onto it.

5. An exercise device comprising:

(a) means for supporting a user in a generally vertical orientation with the arms and legs being free to move;

(b) means for imposing resistance to the movement of the user's arms when moved in a rotary pattern about the shoulder; and (c) means for imposing resistance to the movement of the user's legs when moved in an oscillatory pattern about the hips;

(d) both of said means for imposing resistance comprising a rotatably mounted reel, a cable having a first end which is attached to said reel and a second end for attaching to a limb of the user, spring means for rotatably urging said reel in a direction which will cause said cable to become wound onto it, and clutch means associated with said reel for limiting the rotational speed of said reel when said cable is being wound onto it without limiting its rotational speed when said cable is being unwound from it.

6. An exercise device comprising:

(a) an elongate base which supports the device on a floor;

(b) an upstanding seat support, having a seat located at its upper extremity, attached to said base intermediate the ends thereof, said seat support positioning said seat such that the feet of a person sitting thereon will not touch the floor which is supporting said base;

(c) a post which is attached to said base, at one end thereof, and extends upwardly past the head of a person who is seated in said seat;

(d) first resistance means, attached to said base, for yieldably imposing resistance to the movement of the legs of a person sitting in said seat; and (e) second resistance means, attached to said post, for yieldably imposing resistance to the movement of the arms of a person sitting in said seat;

(f) each of said first and second resistance means having a respective pair of yieldably movable members for imposing resistance on the arms or legs, respectively, of the person, each of said members being movable independently of the movement of any other of said members for imposing resistance to the movement of a single limb of said person independently of the resistance imposed on the movement of any other limb of said person.

7. The device of claim 6, including means for adjustable varying the height of said seat support.

8. The device of claim 6, including means for adjustably varying the height of said post.

9. The device of claim 6, including means for adjusting the position of said first resistance means relative to the position of said seat support.

10. The device of claim 6 wherein each of said first and second resistance means comprises:

(a) a pair of rotatably mounted reels;

(b) each reel including a cable having a first end which is attached to said reel and a second end for attaching to a limb of the user; and (c) spring means on each reel for rotatably urging said reel in a direction which will cause said cable to become wound onto it.

11. An exercise device comprising:

(a) an elongate base which supports the device on a floor;

(b) an upstanding seat support, having a seat located at its upper extremity, attached to said base intermediate the ends thereof, said seat support positioning said seat such that the feet of a person sitting thereon will not touch the floor which is supporting said base;

(c) a post which is attached to said base, at one end thereof, and extends upwardly past the head of a person who is seated on said seat;

(d) means, attached to said base, for imposing resistance to the movement of the legs of a person sitting on said seat;

(e) means, attached to said post, for imposing resistance to the movement of the arms of a person sitting on said seat;

(f) both of said means for imposing resistance comprising a rotatably mounted reel, a cable having a first end which is attached to said reel and a second end for attaching to a limb of the user, spring means for rotatably urging said reel in a direction which will cause said cable to become wound onto it, and clutch means associated with said reel for limiting the rotational speed of said reel when said cable is being wound onto it without limiting its rotational speed when said cable is being unwound from it.

12. The device of claim 1, each of said means for yieldably imposing resistance having a respective pair of yieldably movable members for imposing resistance on the arms of legs, respectively, of the user, each of said members being movable independently of the movement of any other of said members for imposing resistance to the movement of a single limb of said user independently of the resistance imposed on the movement of any other limb of said person.

13. The device of claim 6, wherein said seat comprises means for supporting the person in a generally vertical orientation while permitting the person's legs to move in an oscillatory pattern about the hips while depending downwardly from the hips.

* * * * *

UNITED STATES PATENT AND TRADEMARK OFFICE

CERTIFICATE OF CORRECTION

PATENT NO. : 4,948,119

DATED : August 14, 1990

INVENTOR(S) : Richard T. Robertson, Jr.

It is certified that error appears in the above-identified patent and that said Letters Patent is hereby corrected as shown below:

Col. 3, line 36 insert --.-- between "it" and "In".

Col. 6, line 38 Change "of legs" to --or legs--.

Signed and Sealed this

Fourth Day of February, 1992

*Attest:*

HARRY F. MANBECK, JR.

*Attesting Officer*

*Commissioner of Patents and Trademarks*